US005577561A

United States Patent [19]

Cook

[11] Patent Number: 5,577,561

[45] Date of Patent: Nov. 26, 1996

[54] TITANIUM SKIN-PENETRATING FIRE-FIGHTING TOOL

[75] Inventor: Kenneth E. Cook, Annapolis, Md.

[73] Assignee: Oceaneering International, Inc., Houston, Tex.

[21] Appl. No.: 515,293

[22] Filed: Aug. 15, 1995

Related U.S. Application Data

[63] Continuation-in-part of Ser. No. 155,056, Nov. 19, 1993, abandoned.

[51] Int. Cl.[6] ..... A62C 31/22

[52] U.S. Cl. ..... 169/70; 169/62; 239/271

[58] Field of Search ..... 169/62, 70; 173/62, 173/73, 78; 239/271, 272, 567; 384/275, 276, 295; 408/57, 59, 60

[56] References Cited

U.S. PATENT DOCUMENTS

| | | | |
|---|---|---|---|
| 2,251,175 | 7/1941 | Tappe | 169/67 |
| 2,626,667 | 1/1953 | Spiller | 408/59 X |
| 2,857,005 | 10/1958 | Medlock | 169/62 |
| 3,689,126 | 9/1972 | Hayashi et al. | 384/295 X |
| 3,865,194 | 2/1975 | Chatfield, Jr. | 169/70 |
| 4,147,216 | 4/1979 | Schnepfe, Jr. et al. | 169/70 |
| 4,271,909 | 6/1981 | Chatfield, Jr. et al. | 169/70 |
| 4,676,319 | 6/1987 | Cuthbertson | 169/70 |

*Primary Examiner*—Andrew C. Pike
*Attorney, Agent, or Firm*—Rosenblatt & Redano, P.C.

[57] ABSTRACT

This invention relates to an apparatus and method for penetrating a titanium walled enclosure to dispense a fire fighting agent within the enclosure. A penetrating device is attached to the forward end of a rotatable barrel, providing for penetration of the titanium wall of an enclosure and insertion of the forward end of the barrel through the titanium wall. The rotatable barrel is mechanically coupled to a controllable actuating device, such as a motor. The actuating device is used to rotate the barrel, thereby driving the penetrating device to penetrate into the enclosure, allowing insertion of the penetrating device and the forward end of the rotatable barrel into the enclosure. Fire fighting fluid is dispensed into the enclosure through a fluid channel in the barrel.

18 Claims, 2 Drawing Sheets

TITANIUM SKIN-PENETRATING FIRE-FIGHTING TOOL

RELATED APPLICATIONS

This application is a continuation-in-part of application Ser. No. 08/155,056, filed on Nov. 19, 1993, now abandoned.

FIELD OF THE INVENTION

This invention relates to an apparatus and method for penetrating a walled enclosure to dispense a fire fighting agent within the enclosure.

BACKGROUND OF THE INVENTION

Physically entering an aircraft or similar enclosure to fight a fire or dispense a fire fighting agent in an explosive atmosphere can be very dangerous, exposing the fire fighter to an explosion or other catastrophe. The classical technique used to fight fires in a building structure involves breaking through windows with an axe or other tools, breaking down or chopping through a door, or chopping through a wall or roof. This method has proven to be unsatisfactory in many instances. When windows are broken there is a danger of injury from glass cuts. When the fire inside the building is located close to the wall or door being penetrated, there is also a danger from hot gases and flames, or an explosive action when the building is penetrated. In addition, the use of axes or other penetrating tools is time-consuming and requires considerable effort, allowing the fire to continue burning and spread while the wall is being penetrated.

As a result of the above problems, various devices have been developed for more rapidly penetrating a walled enclosure and introducing a fire fighting agent into the interior. In U.S. Pat. No. 4,676,319 to Cuthbertson, a fire fighting tool is disclosed in which a penetrating means such as a drill bit is attached to one end of a rotatable drive shaft. The shaft extends axially inside a barrel, which also serves as a conduit for a fire fighting agent. The shaft is rotated by a motor, allowing the operator to drill a hole in an enclosure and insert the end of the barrel through the hole. A fire fighting agent is dispensed into the enclosure through the barrel. The Cutherbertson device uses a portable pressurized air bottle to power the tool. This severely limits the number of times that the Cuthbertson device can be used without the need to change air bottles.

In U.S. Pat. No. 4,271,909 to Chatfield, Jr. et al., a modular fire fighting tool is disclosed in which a cylindrical barrel with a drill bit or other penetrating tool at its front end extends forward from a turbine. The turbine is driven by water or other fire extinguishing liquid, and rotates the drill bit to cut a hole in the building wall. One drawback of such prior art devices is that the fire extinguishing liquid used to drive the turbine must be collected for later disposal. Such devices are also limited because dry chemical fire retardants cannot be used to drive the turbine. The barrel is then inserted into the interior of the building, and a valve is operated which allows water to flow down the barrel and out through outlet openings located behind the bit to extinguish the fire.

In U.S. Pat. No. 3,865,194 to Chatfield, Jr. another hydraulically operated fire extinguishing drill is disclosed. After a hole has been cut in the enclosure wall and the barrel inserted, a valve is operated to permit water to issue from the end of the tool and extinguish the flame.

U.S. Pat. No. 2,251,175 to Tappe is somewhat similar in concept to the '909 patent above, in that it uses a hydraulically operated circular saw to cut a hole in a vessel, with a valve controlling the flow of water out of the barrel once the hole has been cut. The tool is mounted on an extension carried by a mobile support frame.

Another penetrator/barrel arrangement is disclosed in U.S. Pat. No. 4,147,216 to Schnepfe, Jr., et al. In this device, which is particularly designed for aircraft fires, a cartridge is fired to drive the cutter through the aircraft skin. The barrel is then moved through the opening and a fire fighting agent is dispensed into the interior of the aircraft.

Another device designed for fighting aircraft files is disclosed in U.S. Pat. No. 2,857,005 to Medlock. In this patent a penetration tool is carried at the end of an extension arm mounted on a truck. The tool punches through the aircraft shell by the forward motion of the truck, which then backs away to leave an outlet in place through which a fire fighting agent can be sprayed into the interior of the aircraft.

The foregoing devices represent improvements in the fire fighting art, in that they permit a more rapid penetration of an aircraft or other enclosure to fight a fire inside. However, they do not solve all of the potential problems. Tools which comprise both a penetration device and a fluid passageway sacrifice much of the passageway by integrating the two features. For example, in U.S. Pat. No. 4,676,319 to Cuthbertson, the shaft by which the motor drives the drilling bit runs through the fluid passageway. This approach greatly reduces the maximum fluid flow and increases the time required to extinguish a fire.

Prior tools also fail to allow for rapid replacement of drilling bits or fluid delivery devices, such as barrels. The ability to rapidly change a drill bit or to change the diameter or length of the barrel can be critical if a part breaks or if a different part will provide better performance. Modern advances in military aircraft materials have resulted in the use of titanium for aircraft hulls. Modern firefighting tools must be capable of rapidly penetrating such titanium skins. Prior art tools do not prove that capability.

Further, drilling tools are subject to significant torque when drilling into an enclosure. The present invention is capable of penetrating the titanium skin of a modem aircraft when only 150 pounds of force is applied against the tool to drive it through the titanium skin. This torque can make the tool difficult to control during the drilling process. Additionally, a considerable back pressure is developed when the tool is inserted into a craft and begins to dispense a fire fighting fluid. This pressure can make it difficult to control the tool, and may even force the tool back out of the craft. However, tools which attempt to overcome the back pressure are difficult to remove when the fire fighting operation has concluded. In addition, some of the prior devices are quite cumbersome and difficult to manually manipulate.

SUMMARY OF THE INVENTION

In view of the above problems associated with the prior art, the object of the present invention is the provision of a novel and improved fire fighting apparatus for conveniently and quickly penetrating an enclosure such as an aircraft to dispense a fire fighting agent into the interior of the enclosure.

Another object is the provision of such an apparatus in which a rotating barrel serves both as a fluid passageway and the means of transmitting rotational force to the penetrating device, so that the interior of the barrel is free of objects which reduce the passageway and restrict fluid flow.

Another object is the provision of such an apparatus in which the rotating barrel can be installed and locked in place by a one-quarter turn instead of being screwed into the housing.

Another object is the provision of such an apparatus in which the torque generated during drilling is overcome by applying a compensating torque via an appropriately positioned extension arm.

Yet another object is the provision of such an apparatus in which both the penetrating mechanism and the surrounding wall are cooled in the course of penetrating the wall, and in which a fluid dispensing barrel is securely held in place inside the craft once penetration has been achieved.

Yet another object is the provision of such an apparatus in which the dispensing barrel rotates to allow easy removal of the device after the fire fighting operation is concluded.

In the achievement of these and other objects of the invention, a combined penetrating and fire fighting tool is provided with a housing having an inlet orifice, an outlet orifice, and a fluid passage communicating between the two. A valve controls the flow of a fire fighting fluid into the inlet orifice, while an elongate, rotatable dispensing barrel is coupled to the outlet orifice to receive fire fighting fluid therefrom. When being connected to the housing, the barrel locks in place with a one-quarter turn. The barrel includes a plurality of outlets near its forward end for dispensing the fire fighting fluid.

A motor is also mounted to the housing and is mechanically coupled to the barrel. A wall penetrating device such as a drill bit is carried at the forward end of the barrel. The drill bit is secured to the barrel by set screws. The valve is adapted to admit a flow of fire fighting fluid into the housing and barrel when the motor is operated, thereby reducing the heating effects of the penetration on the shaft.

The housing is further adapted to allow the attachment of an extension arm oriented essentially perpendicular to the barrel. This arm allows the application of force to counterbalance the torque created during drilling operation.

As an additional feature, the cross-section of the barrel is approximately equal to the size of the opening formed by the penetrating device, and the periphery of the barrel includes a series of rearward directed flutes. Once the barrel has been inserted through the penetrated opening, it is retained against rearward movement by an engagement of the flutes with the surrounding wall.

Further objects and features of the invention will be apparent to those skilled in the art from the following detailed description of preferred embodiments, taken together with the accompanying drawings.

DETAILED DESCRIPTION OF THE PREFERRED EMBODIMENT

Figure 1:
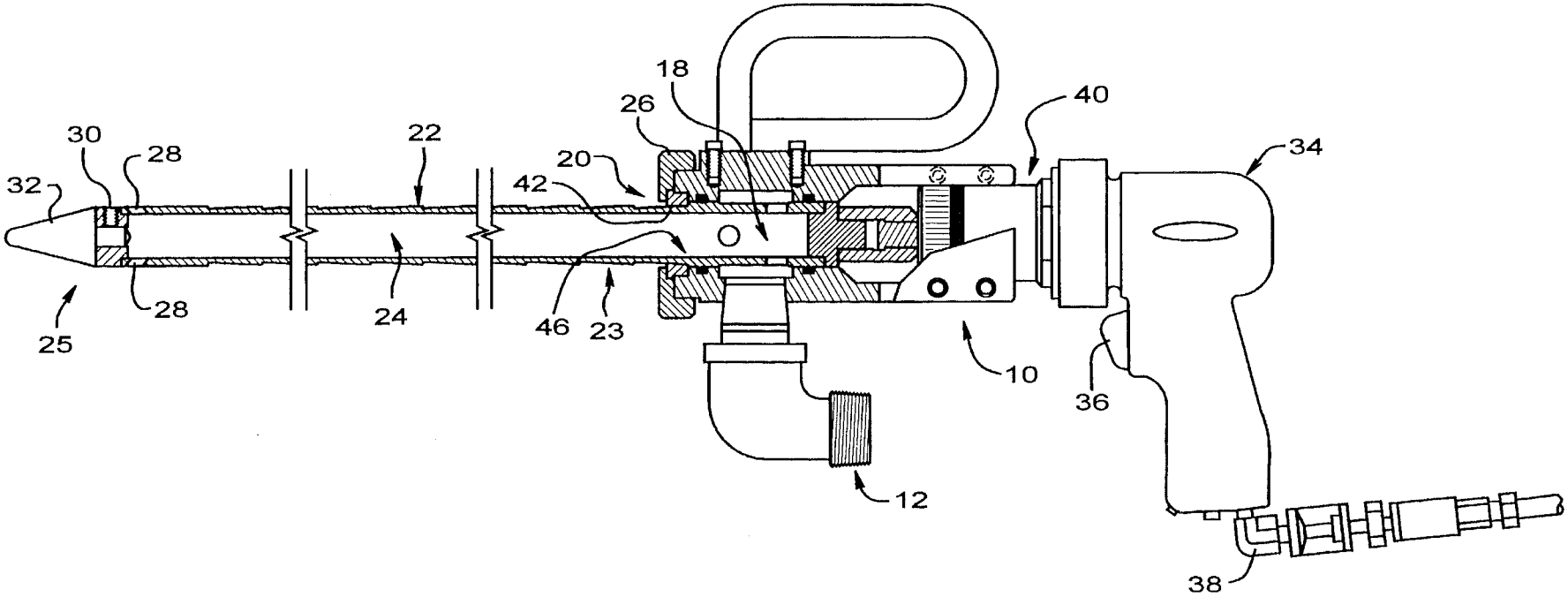
FIG. 1 is a partially cutaway side elevational view of one embodiment of the fire fighting tool.
Figure 2:
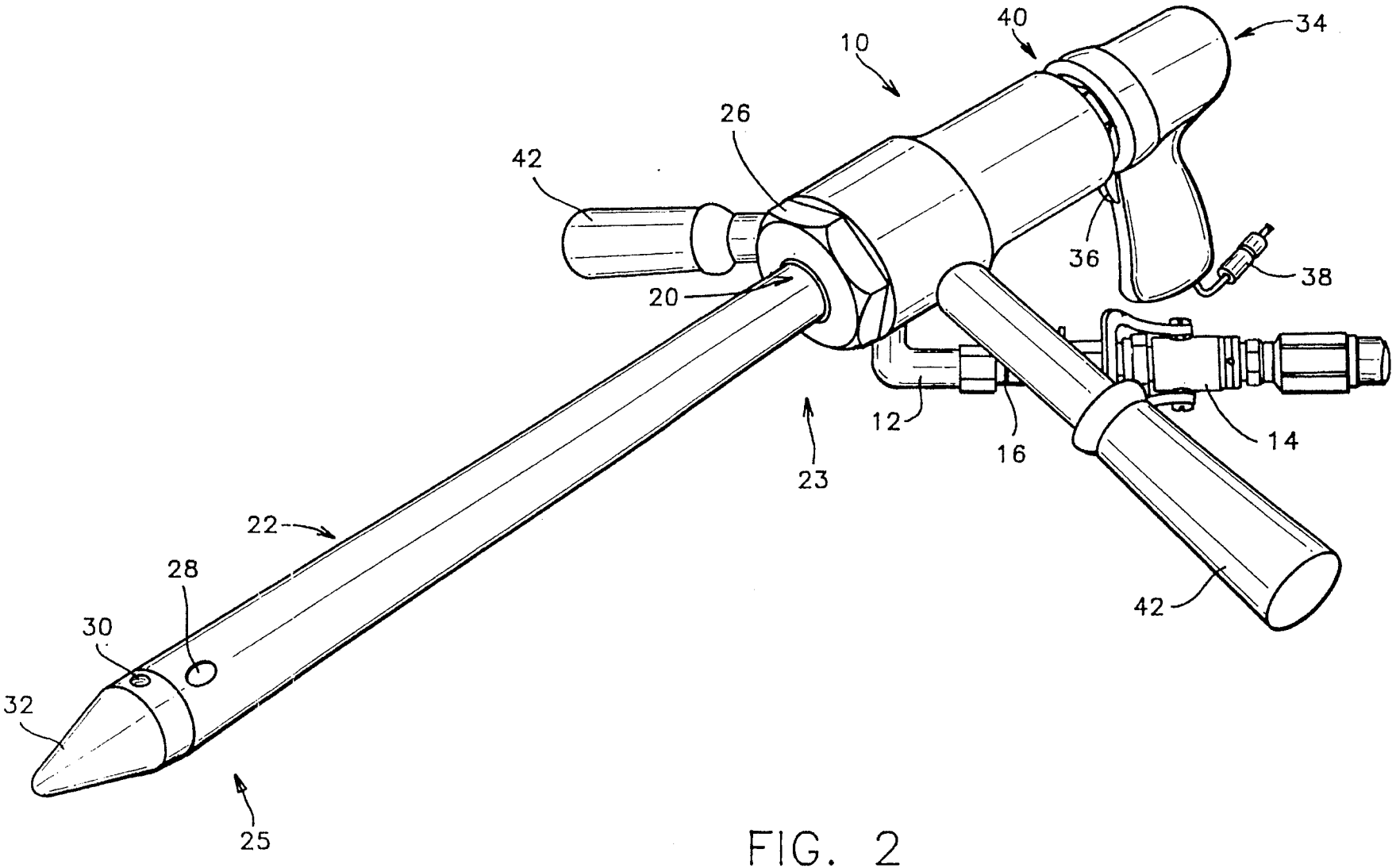
FIG. 2 is an isometric view of one embodiment of the fire fighting tool.

Referring to FIG. 1, the penetrating and fire fighting agent dispensing device is comprised of a housing 10 adapted to receive a fire fighting agent and comprising a discharge outlet 20. The housing 10 further comprises an inlet port 12 capable of receiving a fire fighting agent. As shown in FIG. 2, flow through the inlet port 12 may be controlled by an inlet valve 14. The inlet valve 14 can be a ball-type valve which allows regulation of the rate of flow of the fire-fighting agent. A delivery device to supply the fire fighting agent may be connected to the housing 10 by a quick-disconnect fitting 16 attached to the inlet port 12.

Referring again to FIG. 1, the penetrating and fire fighting agent dispensing device further comprises a rotatable outlet barrel 22 having a first end 23 and a second end 25, the first end 23 of the barrel 22 being attachable to the discharge outlet 20 of the housing 10. The barrel 22 also comprises passaging 24 extending substantially the length of the barrel 22, through which a fire fighting agent may flow and be discharged near the second end 25 of the barrel 22. The barrel 22 further comprises one or more outlet ports 28 near the second end 25 of the barrel 22, the outlet ports 28 being in fluid communication with the passaging 24. The outlet ports 28 may be positioned substantially about the entire circumference of the barrel 22. One or more outlet ports 28 in fluid communication with the passaging 18 may be adapted to direct a portion of the fire fighting agent over the second end of the barrel 22. These outlet ports are of sufficient size and orientation to result in atomization of liquid fire retardant that flows through the barrel, thereby increasing the atomization process most effective in reducing the heat and extinguishing the fire. As shown in FIG. 1, the outlet ports are angled to permit the flow of firefighting agent through the wall of barrel 22 and over the second end 25 of barrel 22. The barrel is sized and shaped to atomize liquid fluid passing through it, thereby increasing flow rate to over 100 gallons/minute and increasing heat transfer in the barrel. The agent enters the housing 10 through the inlet port 12 into a chamber where the barrel 22 is rotating. Holes are provided in the barrel 22 to permit the agent to enter the inside of the hollow barrel 22. The agent then passes through the barrel 22 to the second end 25, where outlet ports 28 are provided to dispense the agent inside of an enclosure after penetrating. In a preferred embodiment the barrel comprises 3 sets of circumferentially spaced holes. Each set of holes is oriented at a different angle from the other 2 sets of holes and placed at a different axial location on the barrel such that the resulting stream of firefighting agent or retardant from one set of holes impinges upon the streams from another set of holes, to facilitate atomization.

In a preferred embodiment, the penetrating and fire fighting agent dispensing device further comprises a locknut 26 mounted on the discharge outlet 20 of the housing 10 such that the barrel 22 is attachable to the housing 10 by inserting the first end 23 of the barrel 22 through the locknut 26, and the locknut 26 is capable of tightly securing the barrel 22, in the housing 10, while still allowing the barrel 22 to rotate, by turning the locknut 26 approximately one quarter turn. The barrel 22 is machined so as to create a shoulder 46 to prevent the bearing 42 from passing beyond a specific point on the barrel. Thus, as shown in FIG. 1, locknut 26 holds bearing 42 securely against barrel shoulder 46, thereby permitting barrel 22 to rotate within bearing 42. The housing 10 is machined so as to create a pocket for the bearing and permit the bearing 42 to protrude from the end of the housing. The housing 10 has one quarter turn counter clockwise threads machined to fit the locknut 26, which can be installed on housing 10 with one quarter turn.

A penetrating member 32 is affixed to the second end 25 of the barrel 22 such that the penetrating member 32 rotates with the barrel 22. The penetrating member 32 may be affixed to the barrel 22 by a threaded set screw 30. Further, the penetrating member 32 may be a conically shaped tip. There is an important relationship between the penetrating member or tip diameter and the force needed to penetrate a titanium aircraft skin. With a ⅜" diameter tip, approximately 200 pounds of force are needed to penetrate a titanium skin. With a ¼" diameter tip only 150 pounds of force are needed to penetrate a titanium skin. In a preferred embodiment a penetrating member having a diameter less than or equal to ¼" is used.

A controllable actuating device 34 is mechanically coupled 40 to the barrel 22 and actuatable to rotate the barrel 22. The actuating device 34 may comprise a motor mechanically coupled to the barrel 22 and capable of rotating the barrel 22. The motor is capable of being continuously operated for a duration necessary to penetrate more than 6 titanium skins without the need to stop the operation of the device. This is achieved by not using a portable air bottle to power the tool. Such portable air bottles expend their fuel contents in less than or equal to 6 penetrations of titanium skins. A trigger 36 may be externally mounted on the housing 10 and coupled to the actuating device 34 such that the actuating device 34 can be selectively turned on or off by depressing the trigger 36. The actuating device 34 may be pneumatically powered. Pneumatic power may be provided via a pneumatic coupling 38 as shown in FIG. 1.

As shown in FIG. 2, an extension arm 42 is designed to be attached to the housing 10 and extend outward from the housing 10 in a direction substantially perpendicular to the barrel 22. The operator of the penetrating and fire fighting agent dispensing device can apply force to the extension arm 42 to overcome the torque created by the rotation of the barrel 22.

Many modifications and variations may be made in the embodiments described herein and depicted in the accompanying drawings without departing from the concept of the present invention. Accordingly, it is understood that the embodiments described and illustrated herein are illustrative only and are not intended as a limitation upon the scope of this invention.

What is claimed is:

1. A penetrating and fire fighting agent dispensing device comprising:

(a) a housing adapted to receive a fire fighting agent and comprising a discharge outlet;

(b) a rotatable outlet barrel having a first end and a second end, the first end of the barrel being attachable to the discharge outlet of the housing, the barrel further comprising passaging extending substantially the length of the barrel, through which the fire fighting agent may flow and be discharged near the second end of the barrel;

(c) a penetrating member affixed to the second end of the barrel such that the penetrating member rotates with the barrel, said member having a sufficiently small diameter to penetrate a titanium aircraft skin when no more than 150 pounds of pressure are applied to said device; and (d) a controllable actuating device mechanically coupled to the barrel and actuatable to rotate the barrel, said device being capable of continuously rotating said barrel for a sufficient period of time to penetrate more than 6 titanium skins without the need to stop the operation of the device.

2. The penetrating and fire fighting agent dispensing device of claim 1, further comprising an extension arm attached to the housing and extending outward from the housing in a direction substantially perpendicular to the barrel.

3. The penetrating and fire fighting agent dispensing device of claim 1, wherein the housing comprises an inlet port capable of receiving the fire fighting agent.

4. The penetrating and fire fighting agent dispensing device of claim 3, further comprising a quick-disconnect fitting attached to the inlet port.

5. The penetrating and fire fighting agent dispensing device of claim 1 further comprising a bearing mounted on said barrel against said housing, and a locknut mounted adjacent to the bearing on the discharge outlet of the housing.

6. The penetrating and fire fighting agent dispensing device of claim 5, wherein said barrel is attachable to the housing by inserting the first end of said barrel through said locknut, and said locknut is capable of tightly securing said barrel in said housing, while still allowing said barrel to rotate.

7. The penetrating and fire fighting agent dispensing device of claim 6, wherein the barrel further comprises one or more outlet ports near the second end of the barrel, the outlet ports being in fluid communication with the passaging.

8. The penetrating and fire fighting agent dispensing device of claim 6, wherein the penetrating member is a conically shaped tip.

9. The penetrating and fire fighting agent dispensing device of claim 8, wherein the penetrating member is affixed to the barrel by a threaded set screw.

10. The penetrating and fire fighting agent dispensing device of claim 1, wherein the actuating device comprises:

(a) a motor mechanically coupled to the barrel and capable of continuously rotating the barrel without refueling for a duration long enough to penetrate at least 6 titanium skins; and (b) a trigger externally mounted on the housing and coupled to the motor such that the motor can be selectively turned on or off by depressing the trigger.

11. The penetrating and fire fighting agent dispensing device of claim 1, wherein the actuating device is pneumatically powered.

12. A penetrating and fire fighting agent dispensing device comprising:

(a) a housing adapted to receive a fire fighting agent and comprising a discharge outlet;

(b) a rotatable outlet barrel having a first end and a second end, the first end of the barrel being attachable to the discharge outlet of the housing, the barrel further comprising passaging extending substantially the length of the barrel, through which the fire fighting agent may flow and be discharged through a plurality of outlet ports near the second end of the barrel;

(c) a penetrating member affixed to the second end of the barrel such that the penetrating member rotates with the barrel, said member having a sufficiently small diameter to penetrate a titanium aircraft skin when no more than 150 pounds of pressure are applied to said device; and (d) a controllable actuating device mechanically coupled to the barrel and actuatable to rotate the barrel, said device being capable of continuously rotating said barrel for a sufficient period of time to penetrate more than 6 titanium skins without the need to stop the operation of the device.

13. The penetrating and fire fighting agent dispensing device of claim 12, further comprising a bearing mounted on said barrel against said housing, and a locknut mounted adjacent to the bearing on the discharge outlet of the housing.

14. The penetrating and fire fighting agent dispensing device of claim 13, wherein said barrel is attachable to said housing by inserting the first end of said barrel through said locknut, and said locknut is capable of tightly securing said barrel in said housing, while still allowing said barrel to rotate.

15. The penetrating and fire fighting agent dispensing device of claim 14, wherein the outlet ports are positioned about the circumference of the barrel.

16. The penetrating and fire fighting agent dispensing device of claim 14, wherein the barrel further comprises an outlet in fluid communication with the passaging and adapted to direct a portion of the fire fighting agent over the second end of the barrel.

17. The penetrating and fire fighting agent dispensing device of claim 14, wherein the penetrating member is attached to the barrel by at least one threaded screw.

18. The penetrating and fire fighting agent dispensing device of claim 14 wherein said barrel is sized to permit a liquid retardant flow rate of at least 100 gallons per minute.

* * * * *